US010251422B2

(12) United States Patent
Koller

(10) Patent No.: US 10,251,422 B2
(45) Date of Patent: Apr. 9, 2019

(54) ELECTRONIC SMOKING ARTICLE

(71) Applicant: Altria Client Services LLC, Richmond, VA (US)

(72) Inventor: Kent B. Koller, Chesterfield, VA (US)

(73) Assignee: Altria Client Services LLC, Richmond, VA (US)

( * ) Notice: Subject to any disclaimer, the term of this patent is extended or adjusted under 35 U.S.C. 154(b) by 835 days.

(21) Appl. No.: 14/332,823

(22) Filed: Jul. 16, 2014

(65) Prior Publication Data

US 2015/0020830 A1 Jan. 22, 2015

Related U.S. Application Data

(60) Provisional application No. 61/856,923, filed on Jul. 22, 2013.

(51) Int. Cl.
*A24B 15/16* (2006.01)
*A24F 47/00* (2006.01)

(52) U.S. Cl.
CPC ..... *A24F 47/008* (2013.01); *A24B 15/16* (2013.01); *A24B 15/167* (2016.11)

(58) Field of Classification Search
CPC ..... A24F 47/008; A24B 15/167
USPC ..... 131/329
See application file for complete search history.

(56) References Cited

U.S. PATENT DOCUMENTS 1,910,403 A * 5/1933 Parr ..... C23F 11/184 210/749
2,856,321 A * 10/1958 Parson ..... C23F 11/184 148/253
4,793,366 A * 12/1988 Hill ..... A24F 47/002 128/202.21
2006/0180795 A1* 8/2006 McCormick ..... C11D 3/0073 252/387
2006/0237097 A1* 10/2006 Lau ..... C23C 22/08 148/242
2009/0095311 A1* 4/2009 Han ..... A24F 47/008 131/194
2009/0289215 A1* 11/2009 Bae ..... C09K 5/20 252/78.5

(Continued)

FOREIGN PATENT DOCUMENTS

EP 2340729 A1 7/2011
KR 20130046729 A 5/2013
WO WO-03101454 A1 12/2003

OTHER PUBLICATIONS

Phosphoric Acid Processing. United States Department of Agriculture. NOSB Materials Database. Published Apr. 1, 2003. Web. https://www.ams.usda.gov/sites/default/files/media/Phos%20acid%20technical%20advisory%20panel%20report.pdf.*

(Continued)

*Primary Examiner* — Eric Yaary
*Assistant Examiner* — Russell E Sparks
(74) *Attorney, Agent, or Firm* — Harness, Dickey & Pierce, P.L.C.

(57) ABSTRACT

An electronic smoking article includes a heater and a liquid aerosol formulation. The heater is a coil heater. The liquid aerosol formulation includes at least one aerosol former, optionally water, nicotine and phosphoric acid. The phosphoric acid is included in an amount sufficient to substantially abate corrosion of the heater.

19 Claims, 1 Drawing Sheet

(56) References Cited

U.S. PATENT DOCUMENTS

| | | | | |
|---|---|---|---|---|
| 2011/0094523 | A1* | 4/2011 | Thorens | A24F 47/008 131/194 |
| 2011/0226236 | A1 | 9/2011 | Buchberger | |
| 2012/0145170 | A1* | 6/2012 | O'Connell | A24B 15/24 131/298 |
| 2012/0211015 | A1* | 8/2012 | Li | A24B 15/167 131/273 |
| 2012/0325228 | A1 | 12/2012 | Williams | |

OTHER PUBLICATIONS

4-Nonylphenyl-polyethylene glycol Material Safety Data Sheet, Sigma Aldrich, https://www.chemblink.com/MSDS/MSDSFiles/9016-45-9_Sigma-Aldrich.pdf, p. 1, Hazards Overiew. (Year: 2011).*

2-Mercaptobenzothiazole, https://www.huidziekten.nl/allergie/stoffen/2-mercaptobenzothiazole.htm. (Year: 2011).*

International Search Report PCT/ISA/210 for International Application No. PCT/US2014/047072 dated Oct. 2, 2014.

Written Opinion of the International Searching Authority PCT/ISA/237 for International Application No. PCT/US2014/047072 dated Oct. 2, 2014.

* cited by examiner

ELECTRONIC SMOKING ARTICLE

CROSS-REFERENCE TO RELATED APPLICATION

This application claims priority under 35 U.S.C. § 119(e) to U.S. provisional Application No. 61/856,923, filed on Jul. 22, 2013, the entire content of which is incorporated herein by reference thereto.

WORKING ENVIRONMENT

Electronic smoking articles include a liquid supply containing a liquid aerosol formulation and a heater. The liquid aerosol formulation can include aerosol formers such as propylene glycol and/or glycerin. It is known that heating glycerin and/or propylene glycol beyond the temperatures required to volatilize the liquid aerosol formulation produces carbonyls.

Heaters formed of alloys including iron tend to corrode and rust over time, producing iron oxide. Iron oxide tends to catalyze reactions with glycerin and/or propylene glycol such that carbonyls and/or carbon monoxide are produced at temperatures below the temperature required to volatilize the liquid aerosol formulation in electronic smoking articles. Abatement of the production of carbonyls and/or carbon monoxide at lower temperatures is desirable.

SUMMARY OF SELECTED FEATURES

An electronic smoking article, such as an electronic cigarette comprises a heater and a liquid aerosol formulation. The liquid aerosol formulation comprises at least one aerosol former, optionally water, optionally nicotine, and phosphoric acid. The phosphoric acid is included in an amount sufficient to substantially abate corrosion of the heater. The heater element can be a wire heater, such as a wire coil formed of a material including iron.

In an embodiment, a method of abating formation of one or more of carbonyls, formaldehyde and carbon monoxide during smoking of an electronic smoking article includes forming a liquid aerosol formulation including phosphoric acid in an amount sufficient to substantially abate corrosion of the heater.

In another embodiment, a liquid aerosol formulation of an electronic smoking article includes at least one aerosol former, optionally water, nicotine, and phosphoric acid in an amount sufficient to substantially abate corrosion of an iron-containing heater of an electronic smoking article.

DETAILED DESCRIPTION

Heaters formed of metal alloys including iron tend to corrode and rust over time, producing iron oxide. During heating of a liquid aerosol formulation including at least one aerosol former, the iron oxide tends to catalyze reactions with glycerin and/or propylene glycol such that carbonyls and/or carbon monoxide are produced at temperatures below the temperature required to volatilize the liquid aerosol formulation. An electronic smoking article which abates corrosion of heaters formed of metal alloys including iron is described herein.

As used herein, the term "electronic smoking article" is inclusive of all types of electronic smoking articles, regardless of form, size or shape, including electronic cigarettes, electronic cigars, electronic pipes, electronic hookahs and the like. The liquid aerosol formulation can include nicotine or be nicotine free. Moreover, the liquid aerosol formulation can include tobacco flavors or instead, or in combination include other suitable flavors.

Preferably, the electronic smoking article comprises a heater formed of a metal alloy including iron and a liquid supply region (or liquid supply) (or reservoir) containing a liquid aerosol formulation including at least one aerosol former and food grade phosphoric acid. Preferably, the phosphoric acid is included in the liquid aerosol formulation in an amount sufficient to substantially prevent corrosion of a heater and avoid formation of one or more of formaldehyde, carbonyls and carbon monoxide resulting from catalytic reactions between iron oxide and the at least one aerosol former.

Figure 1:
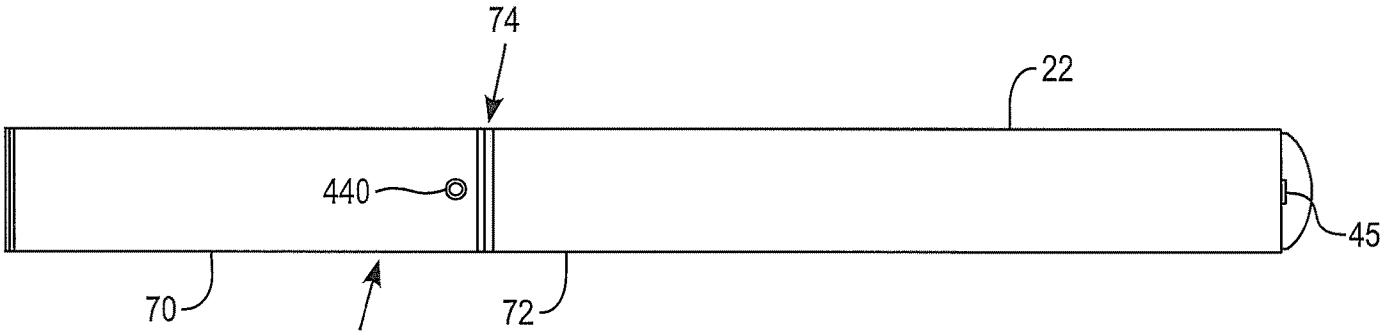
FIG. 1 is a top planar view of an electronic smoking article in the form of an electronic cigarette according to a first embodiment.
Figure 2:
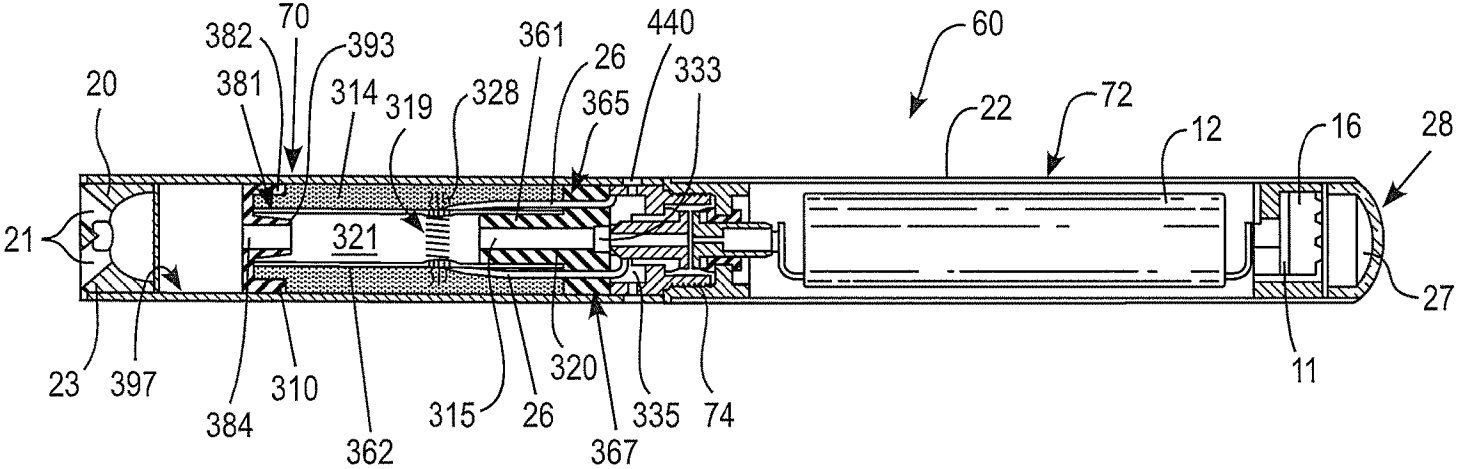
FIG. 2 is a side cross-sectional view of the electronic smoking generating article shown in FIG. 1.

The liquid aerosol formulation disclosed herein forms an aerosol when heated in an electronic smoking article as shown in FIGS. 1 and 2. The electronic smoking article 60 comprises a replaceable cartridge (or first section) 70 and a reusable fixture (or second section) 72, which are coupled together at a threaded joint 74 or by other convenience such as a snug-fit, snap-fit, detent, clamp and/or clasp.

As shown in FIG. 2, the first section 70 can house a mouth-end insert 20, a heater 319, a flexible, filamentary wick 328 and a reservoir 314 as discussed in further detail below.

The second section 72 can house a power supply 12, control circuitry 11, and optionally a puff sensor 16. The threaded portion 74 of the second section 72 can be connected to a battery charger when not connected to the first section 70 for use so as to charge the battery.

Preferably, the first section 70 and the second section 72 include an outer cylindrical housing 22 extending in a longitudinal direction along the length of the electronic smoking article 60. Moreover, in one embodiment, the reservoir 314 of the first section 70 is refillable such that the first section 70 is reusable. In another embodiment, the first section 70 can also be replaceable so as to avoid the need for cleaning the heater 319.

In the preferred embodiment, the electronic smoking article 60 includes a heater 319 and a filamentary wick 328 as shown in FIG. 2. The first section 70 includes an outer tube (or casing) 22 extending in a longitudinal direction and an inner tube (or chimney) 362 coaxially positioned within the outer tube 22. Preferably, a nose portion 361 of an upstream gasket (or seal) 320 is fitted into an upstream end portion 365 of the inner tube 362, while at the same time, an outer perimeter 367 of the gasket 320 provides a liquid-tight seal with an interior surface 397 of the outer casing 22. The upstream gasket 320 also includes a central, longitudinal air passage 315, which opens into an interior of the inner tube 362 that defines a central channel 321. A transverse channel 333 at an upstream portion of the gasket 320 intersects and communicates with the central, longitudinal air passage 315 of the gasket 320. This channel 333 assures communication between the central, longitudinal air passage 315 and a space 335 defined between the gasket 320 and a threaded connection 74.

Preferably, a nose portion 393 of a downstream gasket 310 is fitted into a downstream end portion 381 of the inner tube 362. An outer perimeter 382 of the gasket 310 provides a substantially liquid-tight seal with an interior surface 397 of the outer casing 22. The downstream gasket 310 includes a central channel 384 disposed between the central passage 321 of the inner tube 362 and the mouth end insert 20.

In this embodiment, the reservoir 314 is contained in an annulus between an inner tube 362 and an outer casing 22 and between the upstream gasket 320 and the downstream gasket 310. Thus, the reservoir 314 at least partially surrounds the central air passage 321. The reservoir 314 comprises the liquid aerosol formulation and optionally a liquid storage medium (not shown) operable to store the liquid aerosol formulation therein.

Preferably, the liquid storage medium is a fibrous material comprising cotton, polyethylene, polyester, rayon and combinations thereof. Preferably, the fibers have a diameter ranging in size from about 6 microns to about 15 microns (e.g., about 8 microns to about 12 microns or about 9 microns to about 11 microns). In the alternative, the reservoir 314 may comprise a filled tank lacking a fibrous storage medium and containing only liquid aerosol formulation.

Also preferably, the liquid aerosol formulation has a boiling point suitable for use in the electronic electronic smoking article 60, such as an electronic cigarette. If the boiling point is too high, the heater 319 will not be able to vaporize liquid in the filamentary wick 328. However, if the boiling point is too low, the liquid may vaporize even when the heater 319 is not being activated.

Preferbaly, the heater 319 extends through the central air passage 321 of the inner tube 362. The heater 319 is in contact with the filamentary wick 328, which preferably extends between opposing sections of the reservoir 314 so as to deliver the liquid aerosol formulation from the reservoir 314 to the heater 319.

Preferably, the filamentary wick 328 preferably comprises filaments having a capacity to draw a liquid, more preferably a bundle of glass (or ceramic) filaments and most preferably a bundle comprising a group of windings of glass filaments, preferably three of such windings, all which arrangements are capable of drawing liquid via capillary action via interstitial spacings between the filaments. Preferably, the filamentary wick 328 is flexible and includes three strands, each strand including a plurality of filaments.

Preferably, the electronic smoking article 60 also includes at least one air inlet 440 arranged upstream of the heater 319. In the preferred embodiment, the at least one air inlet 440 includes one or two air inlets. Alternatively, there may be three, four, five or more air inlets. Altering the size and number of air inlets 440 can also aid in establishing the resistance to draw of the electronic smoking article 60.

The power supply 12 can include a battery arranged in the electronic smoking article 60. The power supply 12 is operable to apply voltage across the heater 319 associated with the filamentary wick 328. Thus, the heater 319 volatilizes the liquid aerosol formulation according to a power cycle of either a predetermined time period, such as a 2 to 10 second period.

Preferably, electrical contacts between the heater 319 and the electrical leads 26 are highly conductive and temperature resistant while the heater 319 is highly resistive so that heat generation occurs primarily along the heater 319 and not at the contacts.

The battery can be a Lithium-ion battery or one of its variants, for example a Lithium-ion polymer battery. Alternatively, the battery may be a Nickel-metal hydride battery, a Nickel cadmium battery, a Lithium-manganese battery, a Lithium-cobalt battery or a fuel cell. In that case, preferably, the electronic smoking article 60 is usable by a smoker (vaporer) until the energy in the power supply is depleted. Alternatively, the power supply 12 may be rechargeable and include circuitry allowing the battery to be chargeable by an external charging device. In that case, preferably the circuitry, when charged, provides power for a pre-determined number of puffs, after which the circuitry must be reconnected to an external charging device.

Preferably, the electronic smoking article 60 of each embodiment also includes control circuitry which can be on a printed circuit board 11. The control circuitry 11 can also include a heater activation light 27 that is operable to glow when the heater 319 is activated. Preferably, the heater activation light 27 comprises at least one LED and is at an upstream end 28 of the electronic smoking article 60 so that the heater activation light 27 illuminates a cap which takes on the appearance of a burning coal during a puff. Moreover, the heater activation light 27 can be arranged to be visible to the smoker. In addition, the heater activation light 27 can be utilized for smoking article system diagnostics. The light 27 can also be configured such that the smoker can activate and/or deactivate the light 27 when desired, such that the light 27 would not activate during smoking (vaping) if desired.

The time-period of the electric current supply to the heater 319 may be pre-set depending on the amount of liquid desired to be vaporized. The control circuitry 11 can be programmable and can include an application specific integrated circuit (ASIC). In other embodiments, the control circuitry 11 can include a microprocessor programmed to carry out functions.

As shown in FIG. 2, the electronic smoking article 60 further includes a mouth-end insert 20 having at least two off-axis, preferably diverging outlets 21. Preferably, the mouth-end insert 20 includes at least two diverging outlets 21. (e.g, 3, 4, 5, or preferably 6 to 8 outlets or more). Preferably, the outlets 21 of the mouth-end insert 20 are located at ends of off-axis passages 23 and are angled outwardly in relation to the longitudinal direction of the electronic smoking article 60 (i.e., divergently). As used herein, the term "off-axis" denotes at an angle to the longitudinal direction of the electronic smoking article. Also preferably, the mouth-end insert (or flow guide) 20 includes outlets uniformly distributed around the mouth-end insert 20 so as to substantially uniformly distribute aerosol in a smoker's mouth during use. Thus, as the aerosol passes into a smoker's mouth, the aerosol enters the mouth and moves in different directions so as to provide a full mouth feel as compared to electronic smoking articles having an on-axis single orifice which directs the aerosol to a single location in a smoker's mouth.

In addition, the outlets 21 and off-axis passages 23 are arranged such that droplets of unaerosolized liquid aerosol formulation carried in the aerosol impact interior surfaces of the mouth-end insert 20 and/or interior surfaces of the off-axis passages 23 such that the droplets are removed or broken apart. In the preferred embodiment, the outlets 21 of the mouth-end insert 20 are located at the ends of the off-axis passages 23 and are angled at 5 to 60° with respect to the central longitudinal axis of the electronic smoking article 60 so as to more completely distribute aerosol throughout a mouth of a smoker during use and to remove droplets.

Preferably, each outlet 21 has a diameter of about 0.015 inch to about 0.090 inch (e.g., about 0.020 inch to about 0.040 inch or about 0.028 inch to about 0.038 inch). The size of the outlets 21 and off-axis passages 23 along with the number of outlets 21 can be selected to adjust the resistance to draw (RTD) of the electronic smoking article 60, if desired.

In a preferred embodiment, the electronic smoking article 60 is about the same size as a conventional smoking article. In some embodiments, the electronic smoking article 60 can be about 80 mm to about 110 mm long, preferably about 80 mm to about 100 mm long and about 7 mm to about 8 mm in diameter. For example, in an embodiment, the electronic smoking article is about 84 mm long and has a diameter of about 7.8 mm.

The outer cylindrical housing 22 of the electronic smoking article 60 may be formed of any suitable material or combination of materials. Preferably, the outer cylindrical housing 22 is formed at least partially of metal and is part of the electrical circuit. The outer cylindrical housing 22 can be any suitable color and/or can include graphics or other indicia printed thereon. Although the housing is described herein as cylindrical, other forms and shapes are contemplated.

Preferably, at least one adhesive-backed label is applied to the outer housing 22. The label completely circumscribes the electronic smoking article 60 and can be colored and/or textured to provide the look and/or feel of a traditional cigarette. The label can include holes therein which are sized and positioned so as to prevent blocking of the air inlets 440.

In the preferred embodiment, the heater 319 is a wire coil heater formed of a metal alloy including iron Examples of suitable electrically resistive materials for use in making the heater 319 include titanium, zirconium, tantalum and metals from the platinum group. Examples of suitable metal alloys include stainless steel, nickel-, cobalt-, chromium-, aluminium- titanium- zirconium-, hafnium-, niobium-, molybdenum-, tantalum-, tungsten-, tin-, gallium-, manganese- and iron-containing alloys, and super-alloys based on nickel, iron, cobalt, stainless steel. For example, the heater can be formed of iron aluminide and other composite materials, the electrically resistive material may optionally be embedded in, encapsulated or coated with an insulating material or vice-versa, depending on the kinetics of energy transfer and the external physicochemical properties required. In a preferred embodiment, the heater 319 may be constructed of iron-aluminide (e.g., FeAl or $Fe_3Al$) or a nickel-chromium-iron.

During use, a heater coil including even a small amount of iron (e.g., a wire coil formed of a nickel-chromium-iron alloy) may undergo corrosion, which is identified by visible pitting, discoloration and surface oxygen. While not wishing to be bound by theory, it is believed that the corroded heater 319 reacts with aerosol formers in the reservoir 314 to form carbonyls, formaldehyde, and carbon monoxide during smoking.

It has been found that the addition of food grade phosphoric acid to the liquid aerosol formulation substantially abates potential corrosion of the iron-containing heater 319 and formation of iron oxide. Since formation of iron oxide is abated, iron oxide is not available to catalyze reactions with aerosol formers resulting in the formation of carbonyls and carbon monoxide in the aerosol. Thus, in a preferred embodiment, the liquid aerosol formulation includes at least one aerosol former, optionally water, optionally nicotine, and phosphoric acid in an amount sufficient to substantially prevent corrosion of the heater 319.

In the preferred embodiment, food grade phosphoric acid is added to the liquid aerosol formulation in an amount sufficient to substantially abate corrosion of the iron containing heater so as to reduce the amount of carbonyls and carbon monoxide formed during smoking as compared to liquid aerosol formulations excluding phosphoric acid. Preferably, the phosphoric acid is added in an amount ranging from about 0.1% to about 5% (e.g., about 0.2% to about 5%, about 0.5% to about 4%, about 0.75% to about 3%, or about 1% to about 2%). Preferably, the phosphoric acid is included in amount which is insufficient to alter the pH of the liquid aerosol formulation. While not wishing to be bound by theory, it is believed that acidic liquid aerosol formulations may promote charring of the heater, which can clog the heater and/or filamentary wick resulting in lower aerosol delivery and is therefore to be avoided or minimized.

Also preferably, the at least one aerosol former is selected from the group consisting of propylene glycol, glycerin and combinations thereof. Preferably, the at least one aerosol former is included in an amount ranging from about 40% by weight based on the weight of the liquid formulation to about 90% by weight based on the weight of the liquid formulation (e.g., about 50% to about 80%, about 55% to about 75% or about 60% to about 70%). Moreover, in one embodiment, the liquid formulation can include propylene glycol and glycerin included in a ratio of about 3:2.

Preferably, the liquid formulation also includes water. Water can be included in an amount ranging from about 5% by weight based on the weight of the liquid formulation to about 40% by weight based on the weight of the liquid formulation, more preferably in an amount ranging from about 10% by weight based on the weight of the liquid formulation to about 15% by weight based on the weight of the liquid formulation.

The liquid aerosol formulation optionally includes at least one flavorant in an amount up to about 15% by weight (e.g., about 0.2% to about 15%, about 1% to about 12%, about 2% to about 10%, or about 5% to about 8%). The at least one flavorant can be a natural flavorant or an artificial flavorant. Preferably, the at least one flavorant is selected from the group consisting of tobacco flavor, menthol, wintergreen, peppermint, herb flavors, fruit flavors, nut flavors, liquor flavors, and combinations thereof.

Preferably, the liquid aerosol formulation also includes nicotine. The nicotine is included in the liquid aerosol formulation in an amount ranging from about 1% by weight to about 10% by weight (e.g., about 2% to about 9%, about 2% to about 8%, about 2% to about 6%). In an alternative embodiment, the liquid aerosol formulation can be nicotine-free.

When the word "about" is used in this specification in connection with a numerical value, it is intended that the associated numerical value include a tolerance of ±10% around the stated numerical value. Moreover, when reference is made to percentages in this specification, it is intended that those percentages are based on weight, i.e., weight percentages. The expression "up to" includes amounts of zero to the expressed upper limit and all values therebetween. When ranges are specified, the range includes all values therebetween such as increments of 0.1%.

Moreover, when the words "generally" and "substantially" are used in connection with geometric shapes, it is intended that precision of the geometric shape is not required but that latitude for the shape is within the scope of the disclosure. When used with geometric terms, the words "generally" and "substantially" are intended to encompass not only features which meet the strict definitions but also features which fairly approximate the strict definitions.

It will now be apparent that a new, improved, and non-obvious electronic smoking article, liquid aerosol formulation and method has been described in this specification with sufficient particularity as to be understood by one of ordinary skill in the art. Moreover, it will be apparent to those skilled in the art that numerous modifications, variations, substitutions, and equivalents exist for features of the electronic smoking article, liquid aerosol formulation and method which do not materially depart from the spirit and scope of the invention. Accordingly, it is expressly intended that all such modifications, variations, substitutions, and equivalents which fall within the spirit and scope of the invention as defined by the appended claims shall be embraced by the appended claims.

I claim:

1. An electronic vaping device comprising:

a heater formed of a material including iron; and a formulation, the formulation including, at least one aerosol former; and phosphoric acid, the phosphoric acid included in an amount ranging from about 0.1% by weight to about 5% by weight, such that formation of at least one of formaldehyde, carbonyls, or carbon monoxide resulting from reactions between iron oxides and the at least one aerosol former is reduced compared to a formulation without the phosphoric acid.

2. The electronic vaping device of claim 1, further comprising:

at least one flavorant in an amount ranging from about 0.2% to about 15% by weight.

3. The electronic vaping device of claim 1, wherein the at least one aerosol former includes at least one of propylene glycol, glycerin, or both propylene glycol and glycerin.

4. The electronic vaping device of claim 1, wherein the at least one aerosol former is included in an amount ranging from about 40% by weight to about 90% by weight.

5. The electronic vaping device of claim 3, wherein the formulation comprises glycerin and propylene glycol in a ratio of at least about 2:3.

6. The electronic vaping device of claim 1, wherein nicotine is included in an amount ranging from about 1% by weight to about 10% by weight.

7. The electronic vaping device of claim 1, wherein the phosphoric acid is included in an amount of about 1% by weight.

8. The electronic vaping device of claim 1, wherein the heater is a coil heater in communication with a filamentary wick which draws liquid from a reservoir via capillary action.

9. The electronic vaping device of claim 8, wherein the electronic vaping device further comprises:

an outer tube extending in a longitudinal direction;

an inner tube within the outer tube; and the reservoir comprising the formulation contained in an outer annulus between the outer tube and the inner tube, wherein the coil heater is located in the inner tube and the filamentary wick is in communication with the reservoir and surrounded by the coil heater such that the filamentary wick delivers the formulation to the coil heater and the coil heater heats the formulation to a temperature sufficient to volatilize the formulation and form a vapor.

10. The electronic vaping device of claim 1, wherein the heater is a resistance heating wire formed of a metal alloy containing iron.

11. A formulation of an electronic vaping device, comprising:

at least one aerosol former;

nicotine; and phosphoric acid in an amount ranging from about 0.1% by weight to about 5% by weight, such that formation of at least one of formaldehyde, carbonyls, or carbon monoxide resulting from reactions between iron oxides and the at least one aerosol former is reduced compared to a formulation without the phosphoric acid.

12. The formulation of claim 11, further comprising:

at least one flavorant in an amount ranging from about 0.2% to about 15% by weight.

13. The formulation of claim 11, wherein the at least one aerosol former includes at least one of propylene glycol, glycerin, or both propylene glycol and glycerin.

14. The formulation of claim 11, wherein the at least one aerosol former is included in an amount ranging from about 40% by weight to about 90% by weight.

15. The formulation of claim 13, wherein the formulation comprises glycerin and propylene glycol in a ratio of at least about 2:3.

16. The formulation of claim 11, wherein nicotine is included in an amount ranging from about 1% by weight to about 10% by weight.

17. The formulation of claim 11, wherein the phosphoric acid is included in an amount of about 1% by weight.

18. The electronic vaping device of claim 1, wherein the formulation further includes nicotine, water, or both.

19. The formulation of claim 11, wherein the formulation further includes water.

* * * * *